US007156676B2

(12) United States Patent
Reynolds, Jr.

(10) Patent No.: US 7,156,676 B2
(45) Date of Patent: Jan. 2, 2007

(54) ELECTRICAL CONTRACTORS EMBEDDED IN THREADED CONNECTIONS

(75) Inventor: Harris A. Reynolds, Jr., Houston, TX (US)

(73) Assignee: Hydril Company LP, Houston, TX (US)

( * ) Notice: Subject to any disclaimer, the term of this patent is extended or adjusted under 35 U.S.C. 154(b) by 156 days.

(21) Appl. No.: 10/985,619

(22) Filed: Nov. 10, 2004

(65) Prior Publication Data

US 2006/0108803 A1 May 25, 2006

(51) Int. Cl.
*H01R 4/60* (2006.01)

(52) U.S. Cl. ..... 439/194

(58) Field of Classification Search ..... 439/191–195; 166/65.1

See application file for complete search history.

(56) References Cited

U.S. PATENT DOCUMENTS

| | | | |
|---|---|---|---|
| 3,518,608 | A | 6/1970 | Papadopoulos |
| 3,593,391 | A | 7/1971 | Routh |
| 3,879,097 | A | 4/1975 | Oertle |
| 4,220,381 | A | 9/1980 | van der Graaf |
| RE30,647 | E | 6/1981 | Blose |
| 4,445,734 | A | 5/1984 | Cunningham |
| 4,537,457 | A | 8/1985 | Davis |
| 4,591,226 | A | 5/1986 | Hargett et al. |
| 4,683,944 | A | 8/1987 | Curlett |
| 4,788,544 | A | 11/1988 | Howard |
| 4,799,544 | A | 1/1989 | Curlett |
| 4,836,305 | A | 6/1989 | Curlett |
| 4,913,657 | A | 4/1990 | Naito |
| 4,914,433 | A | 4/1990 | Galle |
| 4,953,636 | A | 9/1990 | Mohn |
| RE34,467 | E | 12/1993 | Reeves |
| 5,360,239 | A | 11/1994 | Klementich |
| 5,454,605 | A | 10/1995 | Mott |
| 5,971,072 | A | 10/1999 | Huber |
| 6,041,872 | A | 3/2000 | Holcomb |
| 6,050,610 | A | 4/2000 | Enderle |
| 6,123,561 | A | 9/2000 | Turner |
| 6,206,436 | B1 | 3/2001 | Mallis |
| 6,223,826 | B1 | 5/2001 | Chau |
| 6,392,317 | B1 | 5/2002 | Hall |
| 6,543,816 | B1 | 4/2003 | Noel |
| 6,578,880 | B1 | 6/2003 | Watts |
| 6,596,121 | B1 | 7/2003 | Reynolds |
| 6,666,274 | B1 | 12/2003 | Hughes |
| 6,670,880 | B1 | 12/2003 | Hall |
| 6,688,396 | B1 | 2/2004 | Floerke |
| 6,717,501 | B1 | 4/2004 | Hall |
| 6,722,706 | B1 | 4/2004 | Church |
| 6,763,887 | B1 | 7/2004 | Boyadjieff |
| 6,799,632 | B1 | 10/2004 | Hall |

*Primary Examiner*—Neil Abrams
(74) *Attorney, Agent, or Firm*—Osha Liang LLP

(57) ABSTRACT

Tubulars for transmitting data in a wellbore and threaded connections having electrical contactors embedded therein. The threaded connection includes a first contactor embedded in electrically insulating material within a first slot formed in the pin thread. A second contactor is embedded in electrically insulating material within a second slot formed in the box thread. Upon selected make-up of the pin member with the box member, the first contactor and the second contactor are in contact such that an electrical signal can be transmitted from the box member to the pin member. The first contactor and the second contactor are isolated by at least one sealing arrangement selected from the group consisting of a thread seal, an electrical connector seal, and at least two seals on opposing sides of the first contactor and the second contactor. Methods of manufacturing and making-up a connection are also disclosed.

17 Claims, 7 Drawing Sheets

ELECTRICAL CONTRACTORS EMBEDDED IN THREADED CONNECTIONS

BACKGROUND OF INVENTION

The goal of accessing data from a drill string has been expressed for more than half a century. As exploration and drilling technology has improved, this goal has become more important in the industry for successful oil, gas, and geothermal well exploration and production. For example, to take advantage of advances in the design of various tools and techniques for oil and gas exploration, it would be beneficial to have real time data, such as temperature, pressure, inclination, salinity, etc., and to be able to send control signals to tools downhole. A number of attempts have been made to devise a successful system for accessing such drill string data and for communicating with tools downhole. These systems can be broken down into four general categories.

The first category includes systems that record data downhole in a module that is periodically retrieved, typically when the drill string is lifted from the hole to change drill bits or the like. Examples of such systems are disclosed in the following U.S. Pat. No. 3,713,334 issued to Vann, et al., U.S. Pat. No. 4,661,932 issued to Howard, et al., and U.S. Pat. No. 4,660,638 issued to Yates. Naturally, these systems have the disadvantage that the data is not available to the drill operator in real time.

A second category includes systems that use pressure impulses transmitted through the drilling fluid as a means for data communication. For example, see U.S. Pat. No. 3,713,089 issued to Claccomb. A chief drawback to this mud pulse system is that the data rate is slow, i.e. less than 10 baud. In spite of the limited bandwidth, it is believed that this mud pulse system is the most common real time data transmission system currently in commercial use.

A third category includes systems that use a combination of electrical and magnetic principles. In particular, such systems have an electrical conductor running the length of the drill pipe, and then convert the electrical signal into a corresponding magnetic field at one end. This magnetic field is passed to the adjacent drill pipe and then converted to back to an electrical signal. An example of such a system is shown in U.S. Pat. No. 6,717,501 issued to Hall et al., and incorporated herein by reference. In the Hall system, each tubular has an inductive coil disposed at each end. An electrical conductor connects the inductive coils within each tubular. When the tubulars are made-up in a string, the inductive coils of each tubular are in sufficiently close proximity that the magnetic fields overlap to allow data transmission across the connection between the tubulars. Because of a partial loss of the signal between each tubular, the commercial embodiment of Hall, which is marketed by Grant Prideco (Houston, Tex.) as Intellipipe™, uses repeater stations positioned at regular intervals in the drill string to boost the signal.

A fourth category includes systems that transmit data along an electrical conductor that is integrated into the drill string. Examples of such systems are disclosed in U.S. Pat. No. 3,879,097 issued to Oertle; U.S. Pat. No. 4,445,734 issued to Cunningham, and U.S. Pat. No. 4,953,636 issued to Mohn. Each of these systems includes forming direct electrical connections between each tubular.

An early system using electrical connections for transmitting telemetry data is disclosed in U.S. Pat. No. 3,518,608 issued to Papadopoulos in 1970, and incorporated herein by reference. That system uses strips of conductors (referred to as "contacts") mounted with an insulating epoxy on a modified portion of the threads on the connection. Papadopoulos discloses the use of threads having a substantially V-shaped form that are modified by topping off (i.e. removal of upper portion of the thread) the crest on the pin thread and cutting a groove in the root of the box thread where the contacts are attached. Papadopoulos discloses that both the male and female contacts are at least one full thread in length (i.e. one pitch). When the connection is made-up, the conductor strips come into contact and are able to transmit an electrical signal across the connection. To ensure electrical contact, Papadopoulos discloses that the female copper contact should be slightly oversized. If wear of the conductors prevents good electrical contact, Papadopoulos discloses that coating the face of the male contact with a mixture of epoxy cement and copper dust can provide the electrical contact. Papadopoulos also discloses that the root space of all the pin threads should be free to maintain a desired communication of fluid between the inside of the drill pipe, through the threads, and to the annular space above the threads. As a result, no fluid pressure gradient can exist across the electrical contact.

Because a drill string can include hundreds of sections of tubulars, electrical connectors must be provided between each tubular section to carry the data signal. Connector reliability is critical because the failure of any one connector will prevent data transmission. A challenge to connector reliability is that the downhole environment is quite harsh. The drilling fluid pumped through the drill string is abrasive and typically has a high salt content. In addition, the downhole environment typically involves high pressures and temperatures, and the drill string is subjected to large stresses from tension, compression, bending, and torque. Surface handling of tubulars also challenges connector reliability. Heavy grease is typically applied at the joints between tubular sections. The connections are "stabbed" together, and then made-up. During the stabbing, electrical contactors are at risk of damage from impacts.

If a reliable transmission system using an electrical signal is achieved, the higher data transmission rates could provide a wealth of information during drilling operations and later during the production of hydrocarbons. Advances in sensors allow for valuable data to be gathered about performance during drilling, the formation surrounding the wellbore, and conditions in the wellbore. The value of that data would increase if it was made available in real time. What is still needed is a connection for a tubular that allows reliable data transmission despite the many challenges to connector reliability present in downhole applications.

SUMMARY OF INVENTION

In one aspect, the present invention relates to a threaded connection for transmitting data through a string of tubulars. The threaded connection a pin member and a box member. The pin member includes a pin thread having a pin thread crest and a pin thread root. The pin thread crest and pin thread root each have a substantially planar portion that is substantially parallel to a central axis of the threaded connection. The pin member further includes a first contactor formed from a first conductive material and embedded in a first electrically insulating material in a first slot formed in the pin thread and a first wire in communication with the first contactor. The box member includes a box thread having a box thread crest and a box thread root. The box thread crest and box thread root each have a substantially planar portion that is substantially parallel to the central axis of the threaded connection. The box member further includes a second contactor formed from a second conductive material and embedded in a second electrically insulating material in a second slot formed in the box thread and a second wire in communication with the second contactor. Upon selected make-up of the pin member with the box member, the first contactor and the second contactor are in contact such that an electrical signal can be transmitted from the box member to the pin member. The first contactor and the second contactor are isolated by at least one sealing arrangement selected from the group consisting of a thread seal, an electrical connector seal, and at least two seals on opposing sides of the first contactor and the second contactor.

In another aspect, the present invention relates to a tubular for transmitting data in a wellbore. The tubular includes a pipe body, a pin member disposed at a first end of the pipe body, and a box member disposed at a second end of the pipe body. The pin member includes a pin thread having a pin thread crest and a pin thread root. The pin thread crest and pin thread root each have a substantially planar portion that is substantially parallel to a central axis of the threaded connection. The pin member further includes a first contactor formed from a first conductive material and embedded in a first electrically insulating material in a first slot formed in the pin thread and a first wire in communication with the first contactor. The box member includes a box thread having a box thread crest and a box thread root. The box thread crest and box thread root each have a substantially planar portion that is substantially parallel to the central axis of the threaded connection. The box member further includes a second contactor formed from a second conductive material and embedded in a second electrically insulating material in a second slot formed in the box thread and a second wire in communication with the second contactor. The tubular further includes a wire in communication with the first contactor and the second contactor.

In another aspect, the present invention relates to a method of manufacturing a threaded connection for transmitting data. The method includes forming a pin thread on a pin member. The pin thread includes a pin thread crest and a pin thread root each having a substantially planar portion that is substantially parallel to a central axis of the threaded connection. The method further includes forming a first slot in one of the pin thread crest and the pin thread root and embedding a first contactor in a first electrically insulating material in the first slot. The first contactor is in communication with a first wire. On the box member, a box thread is formed. The box thread includes a box thread crest and a box thread root each having a substantially planar portion that is substantially parallel to the central axis of the threaded connection. The method further includes forming a second slot in one of the box thread crest and the box thread root and embedding a second contactor in a second electrically insulating material in the second slot. The second contactor is in communication with a second wire. Then, the pin member is made-up with the box member such that the first contactor and the second contactor are in contact. Upon make-up, the first contactor and the second contactor are isolated by at least one sealing arrangement selected from the group consisting of a thread seal, an electrical connector seal, and at least two seals on opposing sides of the first contactor and the second contactor.

In another aspect, the present invention relates to a method of making-up a connection having a pin member and a box member with wedge threads. The method includes applying a selected amount of torque to the connection. The connection includes a contactor embedded in the wedge threads on each of the pin member and the box member. The method further includes determining whether an electrical connection has been formed, and then applying additional torque until the electrical connection has been formed.

Other aspects and advantages of the invention will be apparent from the following description and the appended claims.

DETAILED DESCRIPTION

The invention relates generally to connections and tubulars for use with data transmission. More specifically, the invention relates to threaded connections particularly that have electrical contactors embedded in the threads to allow data transmission through the connections.

Figure 1:
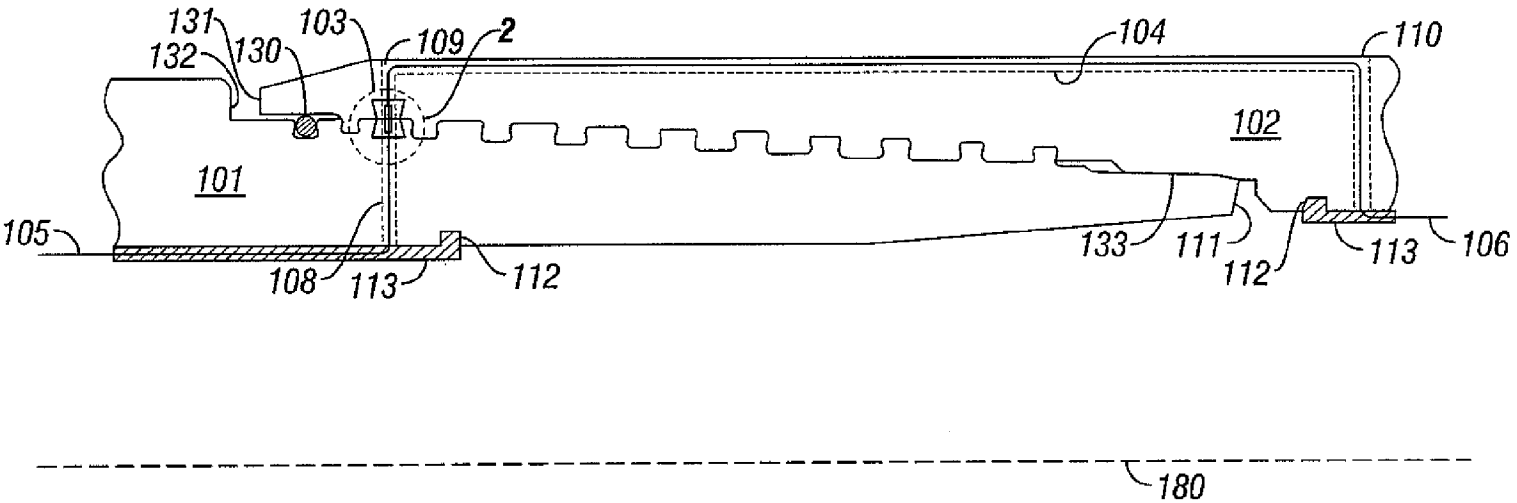
FIG. 1 shows a connection having electrical contactors in accordance with one embodiment of the present invention.
Figure 2:
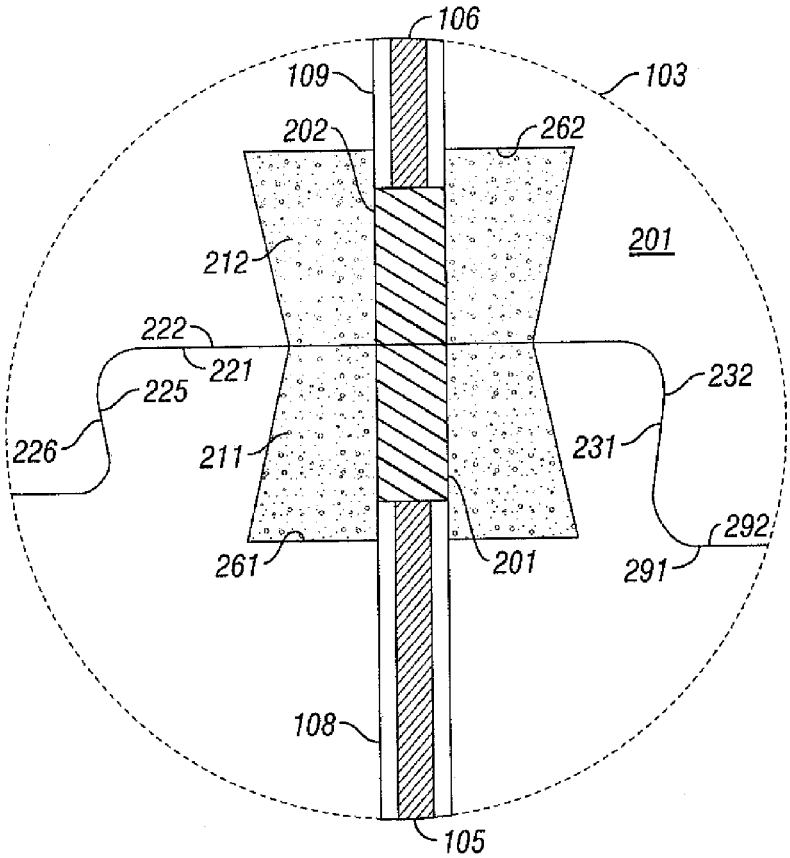
FIG. 2 shows a detailed view of the electrical contactors shown in FIG. 1.

Beginning with FIG. 1, a connection for a tubular in accordance with one embodiment of the present invention is shown. In FIG. 1, the connection includes a pin member 101 and a box member 102. An electrical connection 103 is formed in the threads of the pin member 101 and the box member 102. FIG. 2 provides a detailed view of the electrical connection 103. In this embodiment, the electrical connection 103 is made by the contact between a contactor 201 and a contactor 202, which are made with an electrically conductive material, such as aluminum or copper. Those having ordinary skill in the art will recognize that a number of other materials may be used. In one embodiment, the contactors 201 and 202 may be gold plated copper or other metal. The contactors 201 and 202 are each embedded in an electrically insulating material 211 and 212, respectively, that substantially fills slots 261 and 262. Insulated electrical wires 105 and 106 are connected to the contactors 201 and 202, respectively. The contactors 201 and 202 are located on the threads of pin member 101 and box member 102 such that they form the electrical connection 103 upon a selected make-up of the pin member 101 with the box member 102. As used herein, "make-up" refers to threading the pin member 101 and box member 102 together with a desired amount of torque, or based on a relative position of the pin member 101 with the box member 102. After make-up of the connection, data can be transmitted across the connection via contactors 201 and 202 and through the tubulars via wires 105 and 106.

Continuing with the embodiment shown in FIGS. 1 and 2, the thread form used for the connection has relatively wide flat roots and crests (shown as item 221 on the box thread and item 222 on the pin thread, respectively, in FIG. 2) that are substantially parallel to the central axis 180 of the tubular. The use of a relatively wide thread form provides sufficient area to form slots 261 and 262 in the threads without significantly reducing the strength of the threaded connection. In this particular embodiment, slot 261 is formed in the pin thread crest 222, and slot 262 is formed in the box thread root 221. In an alternative embodiment, slots 261 and 261 for the contactors 201 and 202 may be formed in the pin thread root 292 and box thread crest 291.

The placement of the electrical connection 103 in the embodiment shown in FIG. 1 is due to the characteristics of the thread used for the connection. In FIG. 1, a "wedge thread" is used. "Wedge threads" are characterized by threads that increase in width (i.e. axial distance between load flanks 225 and 226 and stab flanks 232 and 231) in opposite directions on the pin member 101 and box member 102. Wedge threads are extensively disclosed in U.S. Pat. No. RE 30,647 issued to Blose, U.S. Pat. No. RE 34,467 issued to Reeves, U.S. Pat. No. 4,703,954 issued to Ortloff, and U.S. Pat. No. 5,454,605 issued to Mott, all assigned to the assignee of the present invention and incorporated herein by reference. On the pin member 101, the pin thread crest 222 is narrow towards the distal end of the pin member 101 while the box thread crest 291 is wide. Moving along the axis 180 (from right to left), the pin thread crest 222 widens while the box thread crest 291 narrows. In this embodiment, the electrical connection 103 is located near the maximum width of the pin thread crest 222 and box thread root 221.

Generally, it would be preferable to have the electrical connection 103 on the pin thread root 292 and box thread crest 291 for manufacturing purposes because the box thread crests 291 is more accessible. Further, by being located in the pin thread root 292, the contactor 201 would be protected from damage due to handling. When a wedge thread is used, typically, the widest portion of the pin thread root 292 is near the distal end of the pin member 101. On the connection shown in FIG. 1, this location on the pin member 101 coincides with the most likely failure point for the connection. While the embodiments of the present invention minimally affect the overall strength in the connection, the removal of material in the thread could be a potential failure point. Because of this, the connection shown in FIG. 1 has the electrical connection 103 disposed in the pin thread crest 222 and box thread root 221 where both are close to their widest point and exposed to minimal stresses during use. This allows for the most space to locate the contactors 201 and 202 in their respective slots 261 and 262. Those of ordinary skill in the art will appreciate that the electrical connection 103 may be formed at other locations on the pin member 101 and box member 102 based on the characteristics of the connection without departing from the scope of the present invention. For example, if a non-wedge thread (i.e. having constant thread width) is used, the electrical contactors 201 and 201 could be located at a similar location on the connection, but in the pin thread root 292 and root thread crest 291.

Focusing on the detail of the electrical connection 103 shown in FIG. 2, the slots 261 and 262 may be formed substantially centered on the box thread root 221 and pin thread crest 222, which does not affect the area of load flanks 225 and 226 and stab flanks 232 and 231. Because connections are typically designed with a large safety factor for the overall strength of the threads compared to the overall strength of the connection, removal of a middle portion of a thread does not significantly affect the strength of the connection. In this embodiment, slot 261 formed in the pin thread crest 222 is shallower than the overall pin thread height (i.e. is not deeper than the pin thread root 292). For the slot 262 formed in the root thread, in this example the box thread root 221, removing some material from the box member 102 is unavoidable, however, the location near the box face (item 131 in FIG. 1) in this embodiment is not exposed to significant stress. Because of this, any weakening of the box member 102 in the area of the electrical connection 103 has little effect on the strength of the connection.

Figure 3A:
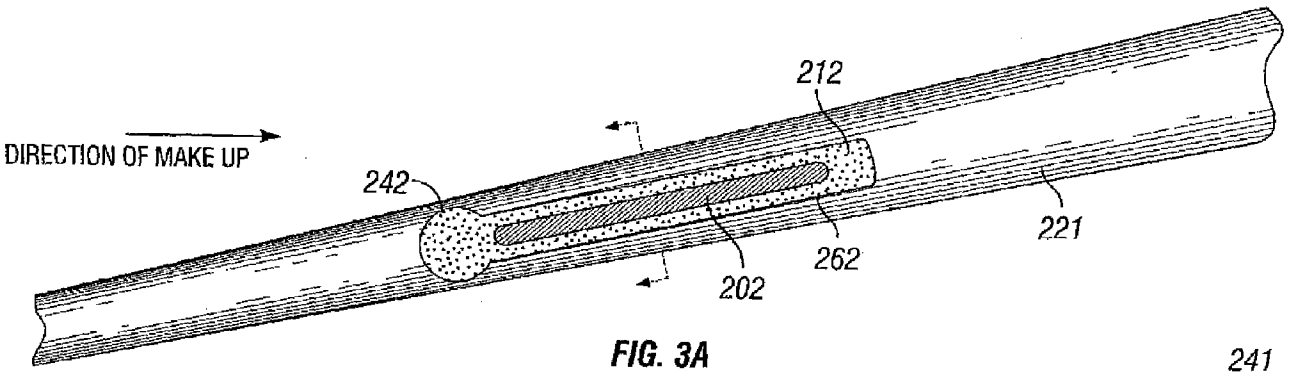
FIG. 3A shows an electrical contactor embedded in a wedge thread in accordance with one embodiment of the present invention.
Figure 3B:
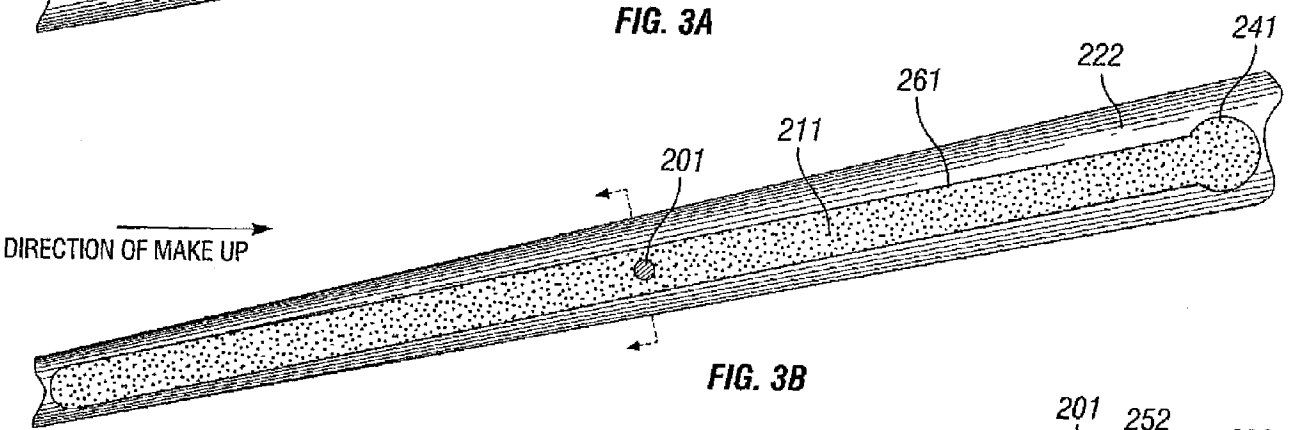
FIG. 3B shows an electrical contactor embedded in a wedge thread and intended to make electrical contact with the electrical contactor shown in FIG. 3A in accordance with one embodiment of the present invention.
Figure 3C:
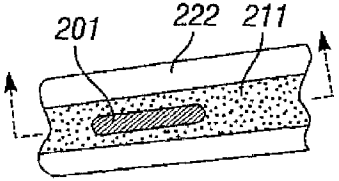
FIG. 3C shows another electrical contactor embedded in a wedge thread and intended to make electrical contact with the electrical contactor shown in FIG. 3A in accordance with one embodiment of the present invention.

In FIGS. 3A, 3B, and 3C, views of "unwrapped" threads having contactors disposed therein are shown in accordance with some embodiments of the present invention. The unwrapped thread view is created by unwinding the thread along the axial length of the connection. Embodiments of the present invention have one contactor that has a greater "helical length" than a second contactor. As used herein, "helical length" refers to the number of turns of the thread that the contactor is disposed, and may be expressed in the number of degrees about the axis of the tubular (i.e. 360 degrees is one thread pitch). The contactor 202 shown in FIG. 3A may be used with either of the contactors 201 shown in FIGS. 3B and 3C to form an electrical connection when the pin member and box member are made up. The thread shown in FIGS. 3A, 3B, and 3C is a wedge thread as shown by the tapered width of the thread. In the particular embodiment shown in FIG. 3A, the contactor 202 is disposed in the box thread root 221 (as shown in FIG. 1 as a cross section). The contactor 202 in FIG. 3A may be longer than a contactor 201 disposed in the pin thread crest 222, such as the embodiments shown in FIGS. 3B and 3C. Those having ordinary skill in the art will appreciate that the contactor 202 may be disposed on thread root or thread crest on the pin member or box member without departing from the scope of the present invention.

Continuing with FIG. 3A, the contactor 202 is disposed in a slot 262 that is filled with an electrically insulating material 212. The slot 262 is substantially centered in the box thread root 221. One method for forming the slot 262 is to use an end mill (not shown) and cut the slot 262 in the previously machined box thread root 221. In this embodiment, a dovetailed (i.e. having an outwardly tapered end) end mill is used. When a dovetailed slot 262 is formed, the mill may plunge into either end of the slot 262. A circular plunge cut 242 is shown at the left end (narrower portion of the thread) of the slot 262. In other embodiments, the slot 262 may not be dovetailed. An advantage of a dovetailed slot 262 is that it may help to prevent the loss of the contactor 202 by providing resistance to the forceful removal of the electrically insulating material 212.

In FIG. 3B, a contactor 201 is shown. Contactor 201 may be adapted to be used with the contactor 202 shown in FIG. 3A. The slot 261 is formed in the portion of the pin thread crest 222 that coincides with the portion of the box thread root 221 shown in FIG. 3A. In this embodiment, slot 261 has been formed in a generally dovetailed shape, as shown by the plunge cut 241 at the right end (wider portion of the thread) of the slot 261. In FIG. 3B, contactor 201 has a generally cylindrical shape with a diameter that is substantially the same as the width as the contactor 202 shown in FIG. 3A. FIG. 3C shows a partial view of an alternate embodiment of the contactor 201. In FIG. 3C, the contactor 201 has a greater helical length than the contactor 201 shown in FIG. 3B, however, both have a shorter helical length than the contactor 202 shown in FIG. 3A.

It should be noted that the contactor 201 shown in FIG. 3B is disposed in a slot 261 that is longer than the slot 262 shown in FIG. 3A. The combination of a longer contactor 202 in a shorter slot 262 with a contactor 201 in a longer slot 261 is a preferable method for solving connection problems caused by uncertainty in the relative position of the pin member 101 and box member 102 after being made-up. Connections are typically made-up to a torque range. Because the variance in torque used to make-up the connection, as well as manufacturing tolerances, affects the relative position of the pin member and the box member, the relative position of contactors 201 and 202 is uncertain. The uncertainty of the final make-up position is generally limited to a range of about 90 degrees to about 180 degrees, but can vary widely based on the characteristics of the connection. To achieve an electrical connection, contactors 201 and 202 must be brought into contact with each other at make-up, and the contactors 201 and 202 must not short out on a portion of the opposing thread.

To ensure electrical contact in spite of indeterminate make-up, a longer contactor 202 may be embedded in electrically insulating material 212 that substantially fills a slot 262 having a helical length to accommodate the longer contactor 202. A shorter complimentary contactor 201 may be embedded in electrically insulating material 211 that substantially fills a slot 261 that has a helical length at least as great as the length of the longer contactor 202. A preferred arrangement to minimize the overall helical length of the electrical connection is to have the smaller contactor 101 embedded in a slot 261 at approximately mid-helical length, with the slot 261 having at least twice the helical length of the longer contactor 202. This ratio ensures that, when electrical contact is made between the longer contactor 202 and shorter contactor 201, the contactor 202 does not contact the pin thread crest 222. Instead, all of the longer contactor 202 would be in contact with the shorter contactor 201 or the surrounding electrically insulating material 211 in slot 261.

Certainty of make-up position is the primary factor in determining the appropriate helical length of the longer contactor, which in turn determines the length of the slot 261 in which the shorter contactor 201 is disposed. Less make-up certainty requires a longer electrical connection, while increased certainty of the relative position of the pin member and box member allows for a shorter electrical connection. The overall length of the electrical connection should be selected to accommodate the expected range of make-up position. For example, a connection with +/−45 degrees of make-up uncertainty should have an electrical connection designed to have electrical contact made over at least a 90 degree range. This may be accomplished by having a longer contactor 202 with a helical length of about 45 degrees and a shorter contactor 201 embedded in a slot 261 having a helical length greater than about 90 degrees. Similarly, a connection with a +/−90 degrees of make-up uncertainty may have a longer contactor 202 with a helical length of about 90 degrees and a shorter contactor 201 embedded in a slot 261 having a helical length greater than about 180 degrees. Those having ordinary skill in the art may vary the helical length of each contactor 201 and 202 as appropriate for the particular connection without departing from the scope of the present invention.

An alternative solution to the make-up uncertainty is to have two contactors 201 and 202 with substantially the same length and embedded near the middle of the helical length of the same size slots 261 and 262. For example, if the make-up uncertainty is +/−90 degrees, two contactors 201 and 202 having helical lengths of about 90 degrees could be centrally located in slots 261 and 262 having helical lengths of about 180 degrees. Those having ordinary skill in the art will appreciate that other relationships in size between the contactors 201 and 202 and slots 261 and 262 may be devised to ensure proper contact between the contactors 201 and 202 without departing from the scope of the present invention.

A property of wedge threads, which typically do not have a positive stop torque shoulder on the connection, is that the make-up is "indeterminate," and, as a result, the relative position of the pin member and box member varies an increased amount for a given torque range to be applied than connections having a positive stop torque shoulder. This characteristic generally requires a helically longer electrical connection when a wedge thread without a positive stop torque shoulder is used. A positive stop torque shoulder is typically formed by having box face 131 (see FIG. 1) contact pin shoulder 132 at the desired make-up position. While a positive stop torque shoulder is optional for a wedge thread, some form of a positive stop is used for non-wedge threads (i.e. free running threads). In some embodiments, a connection is made-up based on a relative position of the box member and the pin member. This is commonly referred to as "positional make-up" or a timed connection. The positional make-up generally corresponds to the desired amount of torque for the connection and can provide more certainty in the relative position of the pin member and box member.

Returning to FIG. 1, other aspects of having tubulars for data transmission are shown. As discussed above, wires 105 and 106 transmit the data signal through the tubular. To route the wires 105 and 106, radial holes 108 and 109 may be formed in the pin member 101 and the box member 102 near the electrical connection 103. During manufacture, wire 105 may be routed through the radial hole 108 and attached to the contactor 201 (see FIG. 2) prior to embedding the contactor 201 in the electrically insulating material 211. The radial hole 108 extends to the inner diameter of the tubular, where the wire 105 may then be routed along the length of the tubular. Because of the typically abrasive fluid pumped through the tubular and various downhole tools that may have to pass through the inside of the tubular downhole, the wire 105 is preferably protected.

Several techniques for protecting a wire inside of a tubular are known in the art. In FIG. 1, a fiberglass pipe liner 113 is expanded into the tubular. This may be performed using the pipe lining techniques disclosed in U.S. Pat. No. 6,569,121 issued to Reynolds, Jr. and assigned to the assignee of the present invention. That patent is incorporated herein by reference. In this particular embodiment, the end of the pipe liner 113 has a feature that is adapted to fit into a groove 112 formed in the inside of the tubular to aid in keeping the pipe liner in the proper location within the tubular. The lining of the tubular may occur after routing the wire 105 such that the wire 105 is trapped between the pipe liner 113 and the inside of the tubular. Another pipe lining technique known in the art is disclosed in U.S. Pat. No. 3,593,391 issued to Routh, and incorporated herein by reference. Routh discloses cementing a plastic or fiberglass filament-wound liner inside the tubular using a cement slurry. In other embodiments, the wire 105 may be coated with a protective layer of epoxy and adhered to the inside of the tubular. Such a technique for protecting a wire is disclosed in the previously discussed U.S. Pat. No. 6,717,501 issued to Hall et al. and in U.S. Pat. No. 3,518,608 issued to Papadopoulos. Those having ordinary skill in the art will appreciate that other techniques for protecting the wire inside the tubular may be used without departing from the scope of the present invention.

Continuing with FIG. 1, the box member 102 requires different routing of wire 106 than the wire 105 in the pin member 101. To route wire 106, a radial hole 109 may be drilled to allow the wire 106 to attach to connector 202 and route towards the outer diameter of the box member 102. Because the outer diameter of the tubular is exposed to friction and impacts with the inside of the wellbore, wire 106 should also be protected. To protect wire 106, an appropriately sized slot 104 may be formed in the outer surface of the box member along the connection. The length of the slot 104 should be selected to be long enough for the wire 106 to route past the length of the threaded portion of the box member 102. At that point, another radial hole 110 may be formed in the box member 102 that goes through to the inside of the tubular. As with wire 105 in the pin member 101, wire 106 may be protected with a liner 113, or other protection method known in the art. To protect the wire 106 on the outside of the box member 102, the slot 104 may be filled with an epoxy or other protective material after placing the wire 106 in the slot 104.

The present inventors believe that in certain embodiments the electrical connection should be isolated from pressure and potential contaminants that can interfere with the electrical connection formed between two contactors. Three general sealing arrangements are proposed for isolating the electrical connection: a thread seal, a seal on each side of the electrical connection, or a seal formed by the electrical connection itself. Any combination of these approaches may be used to ensure that the electrical connection is adequately isolated from pressure and contaminants. Those having ordinary skill in the art will appreciate that other sealing arrangements may be designed to isolate the electrical connection without departing from the scope of the present invention.

FIG. 1 may be used to illustrate an example of a combined thread seal and seal on each side of the electrical connection approach to isolating the electrical connection from fluids. Wedge threads, as shown in FIG. 1, typically exhibit thread sealing, meaning that a pressure seal is actually formed over at least a portion of the threads. A suitable form for a wedge thread capable of a thread seal is disclosed in the previously discussed U.S. Pat. No. RE 34,467 issued to Reeves. Referring to FIG. 2, an effective thread seal may be accomplished with at least some interference of a portion of a pin thread crest 222 and box thread root 221 or pin thread root 292 and box thread crest 291, in addition to the contact between the load flanks 225 and 226 and stab flanks 231 and 232. In one embodiment, root/crest interference may occur at the electrical connection 103 such that a contact pressure is exerted between contactors 201 and 202 when the connection is made-up. In such an embodiment, contactors 201 and 202 may be substantially flush with their respective root and crest. The root/crest interference that provides a thread seal may also provide a more effective electrical connection 103 that exhibits less signal loss.

As discussed above, an alternate sealing arrangement is to have a seal on each side of the electrical connection 103. This sealing arrangement is also shown in embodiment in FIG. 1. In FIG. 1, the connection has an elastomeric seal 130 disposed between the box member 102 and the pin member 101 near the box face 130. On the other end of the connection, a metal to metal seal 133 exists between the box member 102 and pin member 101. In another embodiment, a two-step (i.e. having two thread portions on each of the box member 102 and pin member 101) connection with a mid-seal may be used. An example of a mid-seal is disclosed in U.S. Pat. No. 6,543,816 issued to Noel, and incorporated herein by reference. Those having ordinary skill in the art will appreciate that the location and type of sealing used may vary to isolate the electrical connection without departing from the scope of the present invention.

Figure 4C:
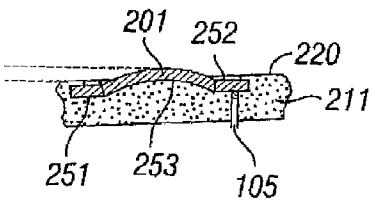
FIG. 4C shows a cross section of the electrical contactor shown in FIG. 3C.
Figure 4A:
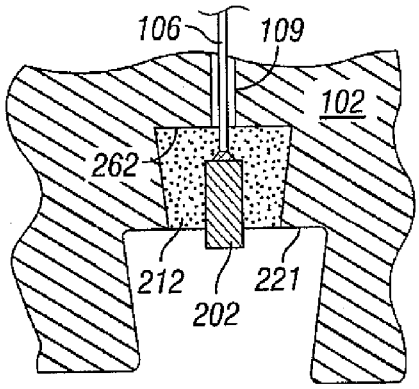
FIG. 4A shows a cross section of the electrical contactor shown in FIG. 3A.
Figure 4B:
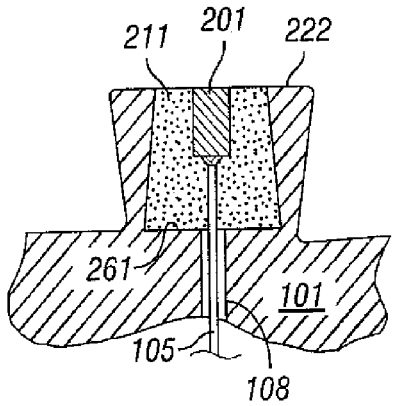
FIG. 4B shows a cross section of the electrical contactor shown in FIG. 3B.
Figure 4D:
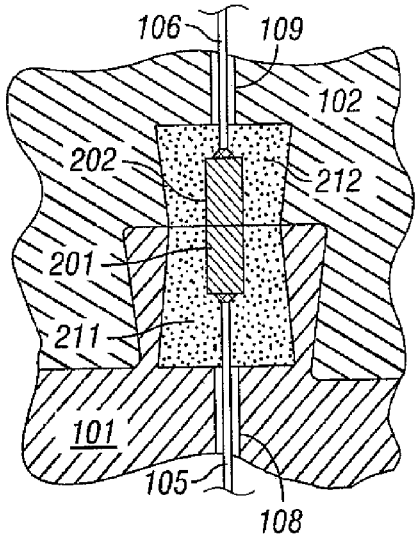
FIG. 4D shows the electrical contactors from FIGS. 3A and 3B making electrical contact.

Turning to FIGS. 4A, 4B, and 4D, an electrical connection in accordance with one embodiment of the present invention is shown. In FIGS. 4A and 4B, two mating contactors 201 and 202 are shown. In FIG. 4D, the contactors 201 and 202 shown in FIGS. 4A and 4B are mated to form an electrical connection. In this embodiment, the contactor 202 is disposed proud of the box thread root 221. The proud contactor 202 may be embedded in an elastomeric electrically insulating material ("EEIM") 212. The use of a proud contactor 202 in combination with the EEIM 212 may accomplish two functions. First, the slot 262 may be substantially filled with the EEIM 212 such that, when the proud contactor 202 is pressed into the slot 262 by contact with the mating contactor 201, the EEIM 212 partially extrudes out of slot 262 to form a seal against the electrically insulating material 211 that substantially fills slot 261. To completely surround the contactors 201 and 202, the longer of the two contactors 201 and 202 may be disposed proud of its respective root or crest. This ensures that all of the conductive portions of the electrical connection are sealed off against fluid and other contaminants. Those having ordinary skill in the art will appreciate that many different elastomeric materials may be used without departing from the scope of the present invention. For example, in one embodiment, the EEIM may be nitrile rubber with about a 90 durometer. How proud the contactors 201 and 202 are disposed has a close relationship to the properties of the insulating material 211 and 212 used. For example, a soft insulating material 211 and 212 with a high elasticity could be used with contactors 201 and 202 disposed very proud, while a hard insulating material 211 and 212, such as Delrin™ (sold by E.I. duPont de Nemours & Co. Wilmington, Del.), may have contactors 201 and 202 mounted substantially flush with their respective root and crest.

In another embodiment, a proud contactor 202 embedded in an EEIM 212 provides a spring force that presses the proud contactor 202 against the mating contactor 201 when the connection is made-up. This may help ensure that an effective electrical connection is formed between contactors 201 and 202. An alternative source for this spring force is shown in FIG. 4C, which is a cross section of the contactor 201 shown in FIG. 3C. As shown in FIG. 4C, the contactor 201 is disposed proud of the pin thread crest 222. To provide a spring force, the contactor 201 has "leaf-spring" shape with a bowed portion 253 with flat ends 251 and 252. When compressed during make-up, the deflection of the bowed portion 253 provides a contact pressure against the mating connector 202 to help provide an effective electrical connection. Those having ordinary skill in the art will appreciate that many forms for electrical contactors 201 and 202 may be used to provide a spring force without departing from the scope of the present invention. For example, in one embodiment, either contactor 201 or 202 may have a semi-circle tubular cross section along the helical length of the contactor 201 or 202. The compression of the semi-circular or fully-circular tubular cross section could provide a spring force when forced into contact during make-up.

As discussed above, having a slot for the contactors that has an outward taper, such as a dovetail, helps to hold the electrically insulating material, and the contactor embedded therein, within the slot. Dovetails are commonly referred to as "trapped" forms because a dovetailed object cannot be pulled upwardly out of a dovetailed slot. As used herein, a "trapped" form means that a portion below the surface of the form is wider than the surface. Therefore, embodiments of the present invention may use trapped forms. Further discussion of trapped forms follows.

Figure 5A:
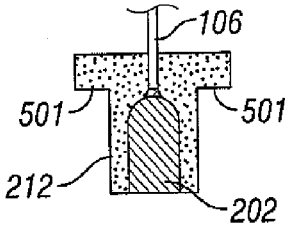
FIG. 5A shows a cross section of an electrical contactor in accordance with one embodiment of the present invention.
Figure 5B:
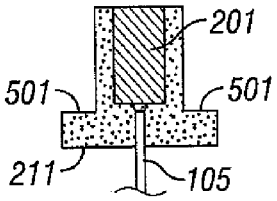
FIG. 5B shows a cross section of an electrical contactor intended to make electrical contact with the electrical contactor shown in FIG. 5A in accordance with one embodiment of the present invention.

In FIGS. 5A, 5B, 6A, and 6B, cross sections of the connectors 201 and 202 embedded in the electrically insulating material 211 and 212 in accordance with multiple embodiments of the present invention are shown. Each of the below described embodiments is intended for slots (261 and 262 in FIG. 2) formed with a trapped profile. In FIGS. 5A and 5B, the electrically insulating material 211 and 212 has a T-shape with extended portions 501. When the electrically insulating material 211 and 212 is inserted or poured and formed into slots 261 and 262 having the forms shown in FIGS. 5A and 5B, the extended portions 501 provide a shear area throughout slots 261 and 262 that resists the removal of the contactors 201 and 202 from their respective slots 261 and 262. Those having ordinary skill in the art that slot 261 on the pin member 101 may not be identical in size and shape to slot 262 on the box member 102.

Figure 6A:
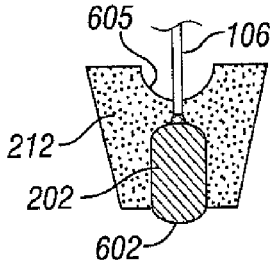
FIG. 6A shows a cross section of an electrical contactor in accordance with one embodiment of the present invention.
Figure 6B:
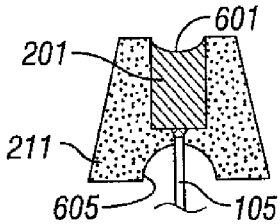
FIG. 6B shows a cross section of an electrical contactor intended to make electrical contact with the electrical contactor shown in FIG. 6A in accordance with one embodiment of the present invention.

In FIGS. 6A and 6B, the electrically insulating material 211 and 212 has a generally dovetailed shape, but also include a hollow curved section 605. The hollow curved sections 605 provide a volume for the electrically insulating material 211 and 212, which is may be nearly incompressible, to fill when compressed by contact between the contactors 201 and 202. In one embodiment, the volume of the hollow curved sections 605 may be about equal to the volume of the contactor 202 that is disposed proud. The desired volume of the hollow curved sections 605 may be less if the electrically insulating material 211 has a higher compressibility. A relief area, such as the hollow curved section 605 may be used to provide a spring like force when an elastomer is used as the insulating material 211 and 212. FIGS. 6A and 6B also show contactors 201 and 202 in accordance with one embodiment of the present invention. Contactors 201 and 202 have mirrored non-planar contact portions 601 and 602, respectively. In this embodiment, contactor 202 has an outwardly curved contact portion 602, and is disposed proud of the electrically insulating material 212. The mating contactor 201 has an inwardly curved contact portion 601. The use of non-planar contact portions 601 and 602 provides a greater contact area between contactors 201 and 202 as compared to planar contactors as shown in the previously discussed embodiments.

Figure 10:
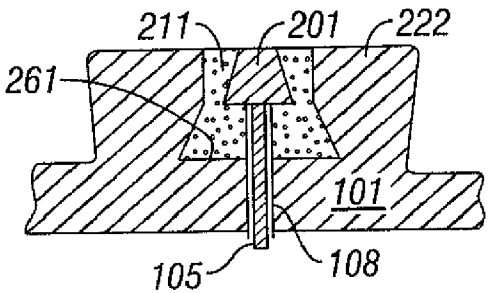
FIG. 10 shows a cross section of an electrical contactor in accordance with one embodiment of the present invention.

In FIG. 10, a contactor 201 in accordance with one embodiment of the present invention is shown. The slot 261 may have an alternate trapped shape as shown in FIG. 10. The contactor 201 also has a trapped shape, which is a dovetailed shape in this embodiment. The trapped contactor 201 may be used to reduce the risk of the contactor 201 being damaged or lost during the handling of the connection. The embodiment shown in FIG. 10 may be formed by pouring an electrically insulating material 211 into previously formed slot 261, which may have wire 105 extending upward from radial hole 108. Prior to the setting of the poured electrically insulating material 211, the contactor 201 may be attached to wire 105 and placed in the electrically insulating material 211 as it sets. This process provides an integral electrical connection with a mechanically locked electrically insulating material 211 and contactor 201, and reduces the need for epoxies to bond the electrically insulating material 211 to the slot 261.

In some embodiments, to prevent electrical interference with the electrical connection, non-conductive dope (i.e. grease) may be used on the connection during make-up instead of typical dope that contains graphite or copper. The use of conductive dope containing graphite or copper may result in attenuation (i.e. loss of power) of the electrical signal, or possibly short of the electrical connection if sufficient dope is in place to provide a conductive path from the electrical connection to a portion of the threads. A non-conductive dope, such as one containing Teflon™ (sold by E.I. duPont de Nemours & Co. Wilmington, Del.), may help to reduce attenuation of the electrical signal across the electrical connection.

Figure 7:
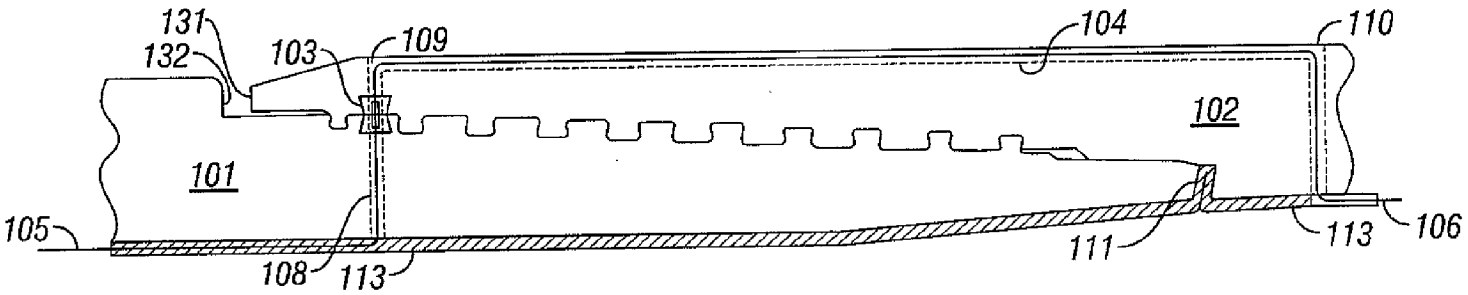
FIG. 7 shows a connection in accordance with one embodiment of the present invention.

Turning to FIG. 7, a connection in accordance with one embodiment of the present invention is shown. In FIG. 7, the tubular has a liner similar to that shown in FIG. 1 and disclosed in the previously discussed U.S. Pat. No. 6,569,121 issued to Reynolds, Jr. The connection in FIG. 7, however, does not contain grooves 112 (see FIG. 1) to hold the liner 113. Instead, the liner 113 extends to the end of the tubulars and pressed between the box member 102 and the pin member 101 at the pin nose 111. In addition to holding the liner 113, the squeezed portion of the liner 113 may also provide a seal between the pin member 101 and the box member 102. In the embodiment shown in FIG. 7, the connection may have a thread seal and/or electrical connection sealing in addition to the seal at the pin nose 111.

Figure 8:
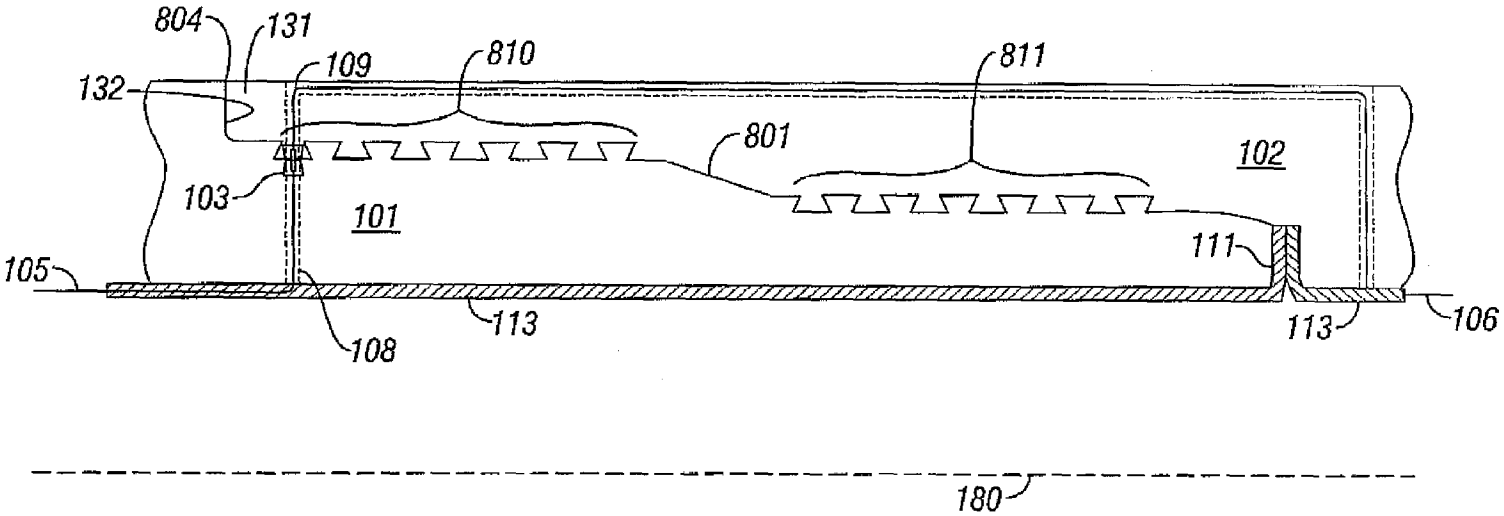
FIG. 8 shows a connection in accordance with one embodiment of the present invention.

In FIG. 8, a free running thread connection in accordance with one embodiment of the present invention is shown. When the connection has a sufficiently wide thread form to accommodate slots for contactors, aspects of the invention may be used with free running threads. If the selected thread is unable to form a sufficient thread seal, other sealing arrangements may be used to isolate the electrical connection 103. In this embodiment, a seal is formed at the positive stop torque shoulder 804 between the box face 131 and the pin shoulder 132. A mid-seal 801, which is located on the other side of the electrical connection 103 from positive stop torque shoulder 804, may be used to isolate the electrical connection 103. The mid-seal 801 is positioned between the two-steps (large step 810 and small step 811). The connection may also include a seal formed at the pin nose 111 between the pin member 101 and the box member 102. In the connection shown in FIG. 8, the electrical connection 103 may be located at any selected portion of the connection based on design considerations of the connection because the free running threads have constant width along the connection. In this embodiment, the electrical connection 103 is disposed in the pin thread root 292 and the box thread crest 291.

Figure 9C:
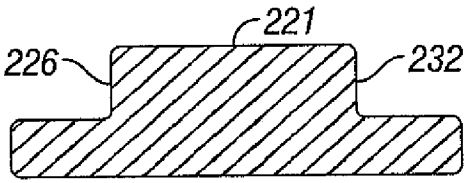
FIGS. 9A, 9B, and 9C show cross sections of some of the thread forms that may be used with embodiments of the present invention.
Figure 9A:
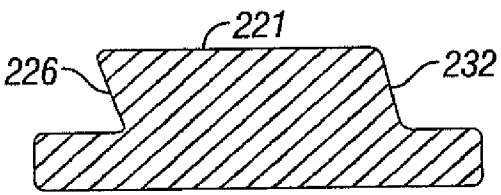
Figure 9B:
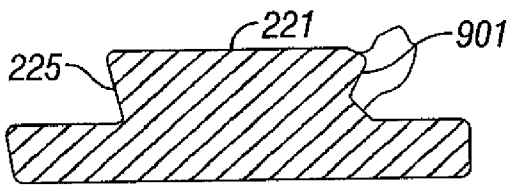

In FIGS. 9A, 9B, and 9C, various thread forms that may be used with embodiments of the present invention are shown. Because embodiments of the present invention have slots formed within the crests and roots of the threads, the selected thread forms should have broad crests and roots relative to the thread height. Generally, thread seals are difficult to achieve with free running threads having broad crests and roots, however, the same thread forms may have thread seals when used for wedge threads. FIG. 9A shows a semi-dovetailed thread form. Such a thread form for wedge threads is disclosed in U.S. Pat. No. 5,360,239 issued to Klementich, and incorporated herein by reference. FIG. 9B shows a thread form having a multi-faceted stab flank 901. In other embodiments, the load flank 225 may also be multi-faceted. Such a thread form is disclosed in U.S. Pat. No. 6,722,706 issued to Church, and incorporated herein by reference. FIG. 9C shows an open thread form with a generally rectangular shape. Such a thread form is disclosed in U.S. Pat. No. 6,578,880 issued to Watts. Each of the above thread forms are example thread forms that may be used for embodiments of the invention having either wedge threads or free running threads. The generally important characteristic is that there is a sufficient thread width to accommodate the electrical connection. Those having ordinary skill in the art will appreciate that sufficient thread width may depend on the particular electrical connection embedded in the thread. For example, an electrical connection with larger gauge wire for transmitted higher power signals would require a wider thread form.

A unique aspect of wedge threads is that the ends of the connection generally have wider roots and crests compared to those of free running threads. A similarly broad thread form on a free running thread would be a fairly coarse thread. A general variable in wedge threads that determines the widest thread relative to the narrowest thread is commonly known as a "wedge ratio." As used herein, "wedge ratio," although technically not a ratio, refers to the difference between the stab flank lead and the load flank lead, which causes the threads to vary width along the connection. A detailed discussion of wedge ratios is provided in U.S. Pat. No. 6,206,436 issued to Mallis, and assigned to the assignee of the present invention. That patent is incorporated herein by reference. As disclosed by Mallis, a wedge thread connection may have two steps (see FIG. 8 of the present application for an example of a two-step threaded connection), with each step having a different wedge ratio. In one embodiment, a larger wedge ratio may be used for the large step such that a broader thread exists on the large step to accommodate the electrical connection.

In embodiments using wedge threads, the indeterminate make-up of the connection may be used to compensate for wear of the contactors. As a wedge thread is made-up, interference between roots and crests of the pin member and box member increases. In one embodiment, the connection having wedge threads may be made-up to a nominal torque value based on the amount of torque required to prevent back-off of the connection during operation. A continuity or "megger" test could be performed to ensure an electrical connection has been formed by the contactors. In one embodiment, the tester may be in the form of a plug inserted into the connection on the opposite end of the tubular being made-up. If the electrical connection has not been formed, the torque may be increased, which increases root/crest interference and, as a result, increases contact pressure between the contactors. When sufficient contact pressure exists between the contactors, the electrical connection will be formed, which would be indicated by the continuity test. In another embodiment, the megger test could be performed as the connection is made-up. Torque could increase without stopping until the torque value is above the minimum and an electrical connection has been formed.

Embodiments of the present invention provide one or more of the following advantages. In the present invention, electrical connections embedded in threads are isolated from much of the harsh environment experienced downhole. This characteristic helps to increase the reliability for the electrical connections. Because of the small footprint of electrical connections disclosed above, the overall strength of the threaded connection is not significantly affected. Further, tubulars containing the electrical connections may be made-up without the need for a significant change in procedures. Because embodiments of the present invention can be designed for repeated make-up and break-down of the connections, the electrical connections may be used for connections on components and drill pipe in a drill string or in the connections for a casing string.

An advantage of having contactors disposed in slots formed in substantially planar roots and crests, rather than topping the threads, is that the strength of the connection is not significantly affected. The placement of the slots does not remove any of the load flank or stab flank, which are subjected to significant loads. The slots only reduce a small portion of the shear area (i.e. thread width multiplied by helical length) of the threads. Most connections are designed to have substantially more shear strength in the threads than the connection can take in tension and compression. Thus, the reduction of shear area over a small portion of the thread does not significantly affect the strength of the connection.

Direct electrical connections, such as through contactors disposed in the threaded connection, result in little signal loss between connections as compared to inductive techniques. As a result, little if any signal boosting is required along the length of the drill string or casing string, which may be over 30,000 feet long (which would in turn have approximately a 1,000 connections). The reduced or eliminated need for amplification decreases the complexity of the data transmission, and may also increase the reliability by removing devices that may fail and prevent data transmission.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A threaded connection for transmitting data through a string of tubulars, the threaded connection comprising:

a pin member comprising, a pin thread having a pin thread crest and a pin thread root, wherein the pin thread crest and pin thread root each have a substantially planar portion that is substantially parallel to a central axis of the threaded connection, a first contactor formed from a first conductive material and embedded in a first electrically insulating material in a first slot formed in the pin thread, and a first wire in communication with the first contactor; and a box member comprising, a box thread having a box thread crest and a box thread root, wherein the box thread crest and box thread root each have a substantially planar portion that is substantially parallel to the central axis of the threaded connection, a second contactor formed from a second conductive material and embedded in a second electrically insulating material in a second slot formed in the box thread, and a second wire in communication with the second contactor, wherein upon selected make-up of the pin member with the box member the first contactor and the second contactor are in contact such that an electrical signal can be transmitted from the box member to the pin member, wherein the first contactor and the second contactor are isolated by at least one sealing arrangement selected from the group consisting of a thread seal, an electrical connector seal, and at least two seals on opposing sides of the first contactor and the second contactor.

2. The threaded connection of claim 1, wherein the first slot is formed in the pin thread crest, the second slot is formed in the box thread root, and the first contactor has a greater helical length than the second contactor.

3. The threaded connection of claim 1, wherein the first slot is formed in the pin thread crest, the second slot is formed in the box thread root, and the second contactor has a greater helical length than the second contactor.

4. The threaded connection of claim 1, wherein the first slot is formed in the pin thread root, the second slot is formed in the box thread crest, and the first contactor has a greater helical length than the second contactor.

5. The threaded connection of claim 1, wherein the first slot is formed in the pin thread root, the second slot is formed in the box thread crest, and the second contactor has a greater helical length than the second contactor.

6. The threaded connection of claim 1, wherein the first electrically insulating material is elastic and the first contactor is disposed proud such the electrical connector seal is formed by partial extrusion of the first electrically insulating material when the first contactor is in contact with the second contactor.

7. The threaded connection of claim 1, wherein the second electrically insulating material is elastic and the second contactor is disposed proud such the electrical connector seal is formed by partial extrusion of the second electrically insulating material when the first contactor is in contact with the second contactor.

8. The threaded connection of claim 1, wherein at least one of the first contactor and the second contactor has a shape that provides a spring force.

9. The threaded connection of claim 1, wherein the first contactor comprises a non- planar first contacting portion that substantially mirrors a non-planar second contacting portion on the second contactor.

10. The threaded connection of claim 1, wherein at least one of the first slot and the second slot has a trapped shape.

11. The threaded connection of claim 1, wherein the pin thread and the box thread have a trapped thread form.

12. The threaded connection of claim 1, wherein the pin thread and the box thread are wedge threads.

13. A tubular for transmitting data in a wellbore, the tubular comprising:

a pipe body;

a pin member disposed at a first end of the pipe body, the pin member comprising, a pin thread having a pin thread crest and a pin thread root, wherein the pin thread crest and pin thread root each have a substantially planar portion that is substantially parallel to a central axis of the tubular, and a first contactor formed from a first conductive material and embedded in a first electrically insulating material in a first slot formed in the pin thread; and a box member disposed at a second end of the pipe body, the box member comprising, a box thread having a box thread crest and a box thread root, wherein the box thread crest and box thread root each have a substantially planar portion that is substantially parallel to the central axis of the tubular, and a second contactor formed from a second conductive material and embedded in a second electrically insulating material in a second slot formed in the box thread; and a wire in communication with the first contactor and the second contactor.

14. The tubular of claim 13, further comprising:

a liner, wherein the wire is disposed between the liner and an inside of the pipe body.

15. The tubular of claim 14, wherein the pin thread and the box thread are wedge threads.

16. A method of manufacturing a threaded connection for transmitting data, the method comprising:

forming a pin thread on a pin member, wherein the pin thread comprises a pin thread crest and a pin thread root, each having a substantially planar portion that is substantially parallel to a central axis of the threaded connection;

forming a first slot in one of the pin thread crest and the pin thread root;

embedding a first contactor in a first electrically insulating material in the first slot, wherein the first contactor is in communication with a first wire;

forming a box thread on a box member, wherein the box thread comprises a box thread crest and a box thread root, each having a substantially planar portion that is substantially parallel to the central axis of the threaded connection;

forming a second slot in one of the box thread crest and the box thread root;

embedding a second contactor in a second electrically insulating material in the second slot, wherein the second contactor is in communication with a second wire; and making-up the pin member with the box member such that the first contactor and the second contactor are in contact, wherein upon make-up, the first contactor and the second contactor are isolated by at least one sealing arrangement selected from the group consisting of a thread seal, an electrical connector seal, and at least two seals on opposing sides of the first contactor and the second contactor.

17. The method of claim 16, wherein the pin thread and the box thread are wedge threads.

* * * * *